US009193546B2

(12) United States Patent
Nakamura

(10) Patent No.: US 9,193,546 B2
(45) Date of Patent: Nov. 24, 2015

(54) SHEET CONVEYING UNIT AND IMAGE FORMING APPARATUS

(71) Applicant: CANON KABUSHIKI KAISHA, Tokyo (JP)

(72) Inventor: Jun Nakamura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/339,616

(22) Filed: Jul. 24, 2014

(65) Prior Publication Data

US 2015/0035227 A1 Feb. 5, 2015

(30) Foreign Application Priority Data

Aug. 1, 2013 (JP) ..... 2013-160373

(51) Int. Cl.

| | |
|---|---|
| ***B65H 9/04*** | (2006.01) |
| ***B65H 5/06*** | (2006.01) |
| ***B65H 9/06*** | (2006.01) |
| ***B65H 5/36*** | (2006.01) |
| ***B65H 9/00*** | (2006.01) |

(52) U.S. Cl.

CPC ..... *B65H 5/062* (2013.01); *B65H 5/36* (2013.01); *B65H 9/004* (2013.01); *B65H 9/06* (2013.01); *B65H 2301/331* (2013.01); *B65H 2403/512* (2013.01); *B65H 2404/722* (2013.01)

(58) Field of Classification Search

CPC ..... B65H 9/00; B65H 9/04; B65H 9/004; B65H 9/06; B65H 2301/331; B65H 2404/70; B65H 2404/72; B65H 2404/722; B65H 2404/725

See application file for complete search history.

(56) References Cited

U.S. PATENT DOCUMENTS

| | | | | |
|---|---|---|---|---|
| 6,011,948 | A * | 1/2000 | Amano et al. | 399/395 |
| 7,584,960 | B2 * | 9/2009 | Ha | 271/246 |
| 8,172,227 | B2 * | 5/2012 | Furusawa et al. | 271/265.01 |
| 8,342,519 | B2 | 1/2013 | Watanabe et al. | |
| 8,387,975 | B2 * | 3/2013 | Suzuki | 271/243 |
| 8,439,358 | B2 * | 5/2013 | Watanabe et al. | 271/243 |
| 8,459,642 | B2 * | 6/2013 | Suzuki | 271/245 |
| 8,616,548 | B2 | 12/2013 | Watanabe et al. | |
| 8,973,918 | B2 * | 3/2015 | Muramatsu et al. | 271/243 |
| 2011/0089628 | A1 | 4/2011 | Watanabe et al. | |
| 2012/0093554 | A1 * | 4/2012 | Suzuki | 399/381 |
| 2013/0087968 | A1 | 4/2013 | Watanabe et al. | |
| 2014/0077441 | A1 | 3/2014 | Watanabe et al. | |

FOREIGN PATENT DOCUMENTS

| | | | |
|---|---|---|---|
| WO | 2011/048668 | A1 | 4/2011 |
| WO | 2011048668 | A1 | 4/2011 |

* cited by examiner

*Primary Examiner* — Ernesto Suarez

(74) *Attorney, Agent, or Firm* — Fitzpatrick, Cella, Harper & Scinto

(57) ABSTRACT

A sheet conveying unit includes a shutter portion including an abutting portion correcting a skew of a sheet by abutting against a front end of the sheet at a standby position upstream in a sheet conveying direction of a nip of the conveying roller pair, and a bias portion biasing the shutter portion such that the abutting portion is positioned at the standby position. The bias portion is configured such that a rate of increase of a bias force applied from the bias portion to the shutter portion during when the abutting portion is turned from the standby position to a nip position where the sheet is nipped by the conveying roller pair is smaller than a rate of increase of the bias force during when the abutting portion turns by being pushed by the sheet nipped by the conveying roller pair from the nip position.

13 Claims, 6 Drawing Sheets

SHEET CONVEYING UNIT AND IMAGE FORMING APPARATUS

BACKGROUND OF THE INVENTION

1. Field of the Invention

The present invention relates to a sheet conveying unit configured to convey a sheet while correcting a skew thereof and an image forming apparatus including the same.

2. Description of the Related Art

Hitherto, an image forming apparatus forming an image on a sheet is provided with a sheet conveying unit configured to convey the sheet while correcting a skew of the sheet conveyed to an image forming portion in order to form the image on the sheet without inclination. For example, International Publication No. 2011/048668 discloses a sheet conveying unit including a shutter member biased in a direction opposite to a sheet conveying direction and correcting a skew by abutting a front end of a sheet against an abutting surface of the shutter member.

The sheet conveying unit described in International Publication No. 2011/048668 includes the shutter member turning in one direction. The shutter member is biased by a bias portion such that the abutting surface is positioned at a standby position after turning by being pushed by the sheet. The bias portion includes a bias spring, generates a reaction force against the sheet in the shutter member when the front end of the sheet abuts against the abutting surface, and generates a force for positioning a next abutting surface at the standby position after when a rear end of the sheet passes through.

However, because the sheet conveying unit described above generates the reaction force when the front end of the sheet abuts against the abutting surface by the bias force of the bias spring, there is a possibility that the front end of the sheet is flawed by dents or the like when the front end of the sheet abuts against the abutting surface if the bias force is large. There is also another possibility that the conveyance of the sheet is delayed when the sheet pushes and turns the shutter member if the bias force is large. Meanwhile, it is preferable to increase the bias force of the bias portion to position the shutter member reliably at the standby position after when the rear end of the sheet passes through. Thus, it is hard to achieve both the prevention of the dent and delay of the sheet and the reliable return of the shutter member to the standby position by the configuration in which the shutter member is biased by the bias portion.

SUMMARY OF THE INVENTION

According to first aspect of the invention, a sheet conveying unit includes a conveying roller pair conveying a sheet, a shutter portion including an abutting portion correcting a skew of a sheet by abutting against a front end of the sheet at a standby position upstream in a sheet conveying direction of a nip of the conveying roller pair, the abutting portion turning by being pushed by the sheet to a recede position where the sheet is permitted to pass through, and a bias portion biasing the shutter portion such that the abutting portion is positioned at the standby position, the bias portion configured such that a rate of increase of a bias force applied from the bias portion to the shutter portion during when the abutting portion is turned from the standby position to a nip position where the sheet is nipped by the conveying roller pair is smaller than a rate of increase of the bias force during when the abutting portion turns by being pushed by the sheet nipped by the conveying roller pair from the nip position.

According to a second aspect of the invention, a sheet conveying unit includes a turning shaft, a shutter member attached to the turning shaft and including a plurality of abutting members projecting in an outer radial direction from an outer circumferential surface thereof and provided at predetermined intervals in a circumferential direction, a cam attached to the turning shaft, the cam including, on its outer circumferential surface corresponding to each abutting member, a plurality of sets of a resistance cam surface generating a force resistant to a turn of the shutter member through the intermediary of the turning shaft when the shutter member turns in a turning direction by being pushed by the sheet abutting against the abutting member, and a driving cam surface formed continuously to the resistance cam surface and generating a force of turning the shutter member in the turning direction, and a bias mechanism including a cam contact member being in contact with the outer circumferential surface of the cam and a bias member biasing the cam contact member to the cam, wherein the resistance cam surface includes a first cam surface with which the cam contact member is in sliding contact until the shutter member turning by a predetermined angle and a second cam surface with which the cam contact member is in sliding contact in the shutter member turning more than the predetermined angle, and wherein the first cam surface is formed such that a pressure angle of the first cam surface with the cam contact member is smaller than a contact angle of the second cam surface with the cam contact member.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

An image forming apparatus according to an embodiment of the present invention will be described with reference to FIGS. 1 through 6. The image forming apparatus of the embodiment of the present invention includes a sheet conveying unit having a skew correcting unit configured to correct a skew of a sheet such as a copier, a printer, a facsimile, and a multi-function printer. The following embodiment will be explained by exemplifying an electro-photographic color laser beam printer (referred to simply as a 'printer' hereinafter) 10 including sheet conveying portion (sheet conveying unit) having a skew correcting portion (skew correcting unit). At first, an entire structure of the printer 10 of the embodiment will be explained with reference to FIG. 1.

Figure 1:
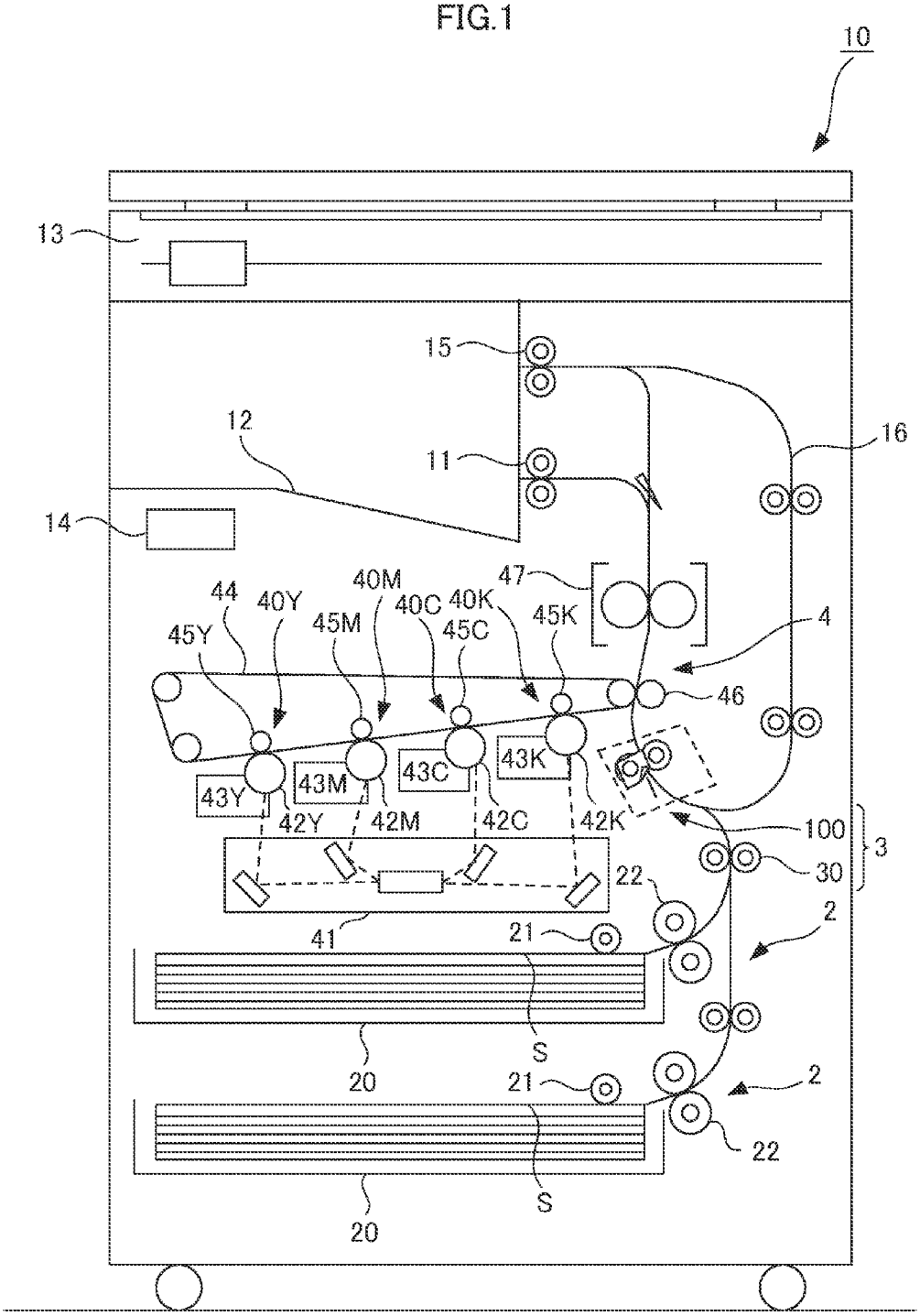
FIG. 1 is a section view schematically showing an entire structure of a printer according to an embodiment of the present invention.

As shown in FIG. 1, the printer 10 includes a sheet feed portion 2 feeding a sheet S, a sheet conveying portion 3 conveying the sheet S fed from the sheet feed portion 2, and an image forming portion 4 forming an image on the sheet S conveyed thereto by the sheet conveying portion 3. The printer 10 also includes a discharge roller pair 11 discharging the sheet S on which the image has been formed, a discharge tray 12 on which the discharged sheet S is stacked, an image reading unit 13 capable of reading an image of a document, and a control portion 14 controlling these portions and units described above.

The sheet feed portion 2 includes a sheet feed cassette storing the sheet S, a feed roller 21 feeding the sheet S stored in the sheet feed cassette 20, and a separating and conveying portion 22 conveying the sheet S fed by the feed roller 21 while separating one by one.

The sheet conveying portion 3 includes a first conveying roller pair (sheet conveying portion) 30 conveying the sheet S conveyed thereto by the separating conveying portion 22, and a skew correcting portion 100 correcting a skew of the sheet S conveyed thereto by the first conveying roller pair 30. It is noted that the skew correcting portion 100 will be described later in detail. Still further, although the sheet conveying portion 3 will be explained by exemplifying the first conveying roller pair 30 in the present embodiment, the sheet conveying portion is not limited to a roller pair as long as the sheet conveying portion is configured to be able to convey a sheet.

The image forming portion 4 includes four process cartridges 40Y, 40M, 40C, and 40K forming four color images of yellow (Y), magenta (M), cyan (C), and black (K), and a laser scanner unit 41 irradiating a laser beam based on image information. The process cartridge 40Y includes a photoconductive drum 42Y on which an electrostatic latent image is formed and a developer 43Y developing the electrostatic latent image on the photoconductive drum 42Y. It is noted that because the four process cartridges 40Y through 40K are constructed in the same manner except of the colors of the images to be formed, an explanation of the process cartridges 40M through 40K will be omitted here. The image forming portion 4 also includes an intermediate transfer belt 44 on which toner images of the photoconductive drum 42Y through 42K are primarily transferred, and primary transfer rollers 45Y, 45M, 45C, and 45K primarily transferring the toner images on the photoconductive drum 42Y through 42K to the intermediate transfer belt 44. The image forming portion 4 also includes a secondary transfer roller 46 secondarily transferring the primarily transferred toner image on the sheet S and a fixing portion 47 heating and fixing the secondarily transferred toner image.

Next, a print job (image forming job) under control of the control portion 14 of the printer 10 constructed as described above will be explained.

In response to start of a print job carried out in accordance to settings made through a manipulating portion not shown, the laser scanner unit 41 irradiates a laser beam to the photoconductive drum 42Y through 42K based on image information inputted through the image reading unit 13, an external personal computer, or the like. At this time, the photoconductive drums 42Y through 42K are charged with negative potential in advance, and the electrostatic latent images are formed on the photoconductive drum 42Y through 42K by the irradiation of the laser beam. The electrostatic latent images are reversely developed by the developers 43Y through 43K and negatively charged toners adhere on the electrostatic latent images. Thus, the toner images of yellow (Y), magenta (M), cyan (C), and black (K) are formed on the photoconductive drum 42Y through 42K.

The toner images of the respective colors formed on the photoconductive drum 42Y through 42K are superimposed and transferred sequentially from the photoconductive drum 42Y to the intermediate transfer belt 44 by applying positive bias to the primary transfer rollers 45Y through 45K. The four color toner images superimposed and transferred to the intermediate transfer belt 44 are conveyed by the rotationally driven intermediate transfer roller 44 to the secondary transfer roller 46.

In parallel with the toner image forming operation, the sheet S stored in the sheet feed cassette 20 is fed one by one by the feed roller 21 and the separating conveying portion 22 to the first conveying roller pair 30, and the first conveying roller pair 30 conveys the sheet S thus fed to the skew correcting portion 100 with a predetermined timing. The skew correcting portion 100 conveys the sheet S to a transfer nip between the secondary transfer roller 46 and the intermediate transfer belt 44 while correcting a skew of the sheet S. The four color toner images on the intermediate transfer belt 44 is secondarily transferred to the sheet S thus conveyed to the transfer nip by applying the positive bias to the secondary transfer roller 46. The sheet S on which the toner images have been transferred is conveyed to the fixing portion 47 and the toner images are fixed by heat and pressure applied at the fixing portion 47.

After that, the sheet S on which the toner images have been fixed is discharged by the discharge roller pair 11 to the discharge tray 12. It is noted that in a case where images are formed on both surfaces of the sheet S, the sheet S is conveyed to a duplex conveying path 16 in a state in which the sheet S is reversed by a reversing roller pair 15. After passing through the duplex conveying path 16, the sheet S is conveyed again to the image forming portion 4 and the image forming operation described above is repeated.

Next, the skew correcting portion (skew correcting unit) 100 described above will be explained specifically with reference to FIGS. 2 through 6. At first, a configuration of the skew correcting portion 100 will be explained with reference to FIGS. 2 through 4.

Figure 2:
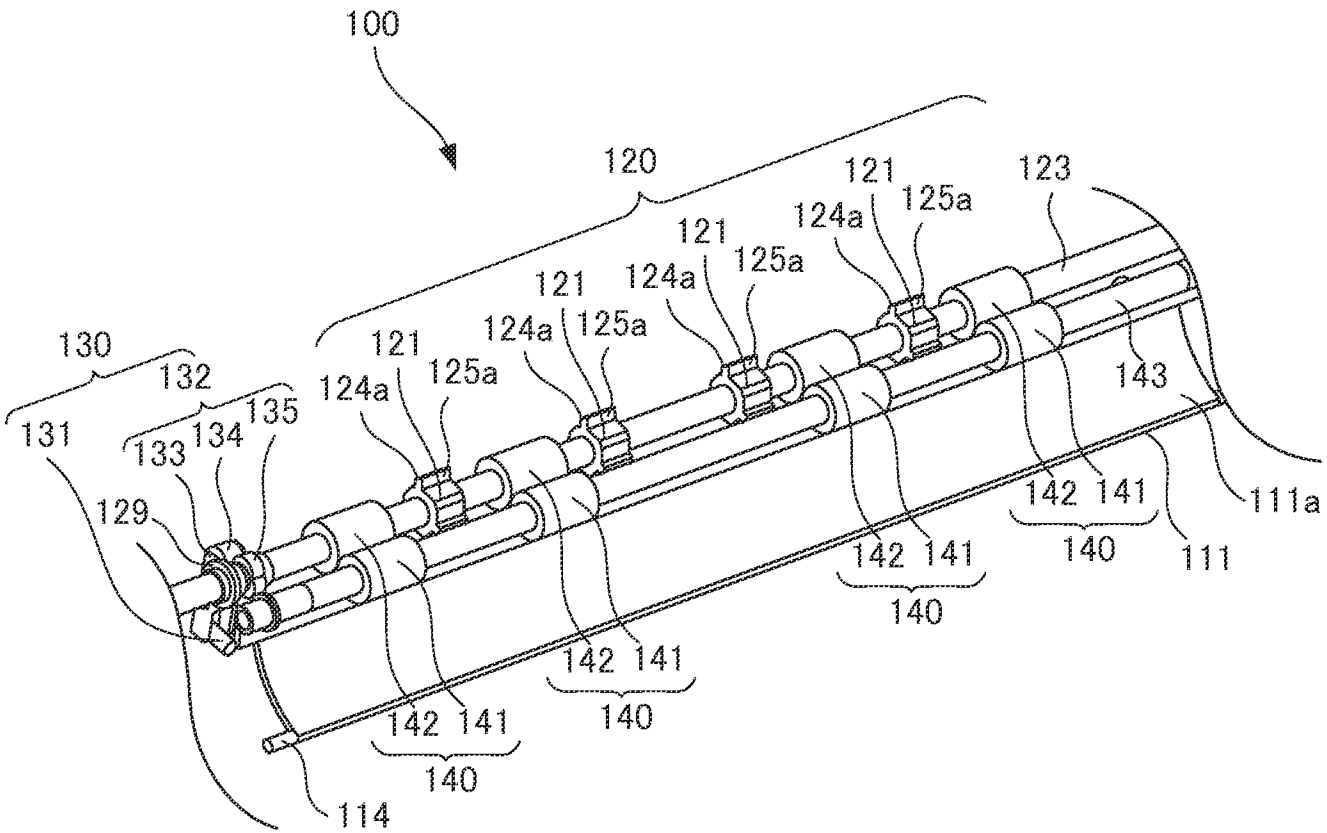
FIG. 2 is a perspective view of a skew correcting portion of the present embodiment.
Figure 3:
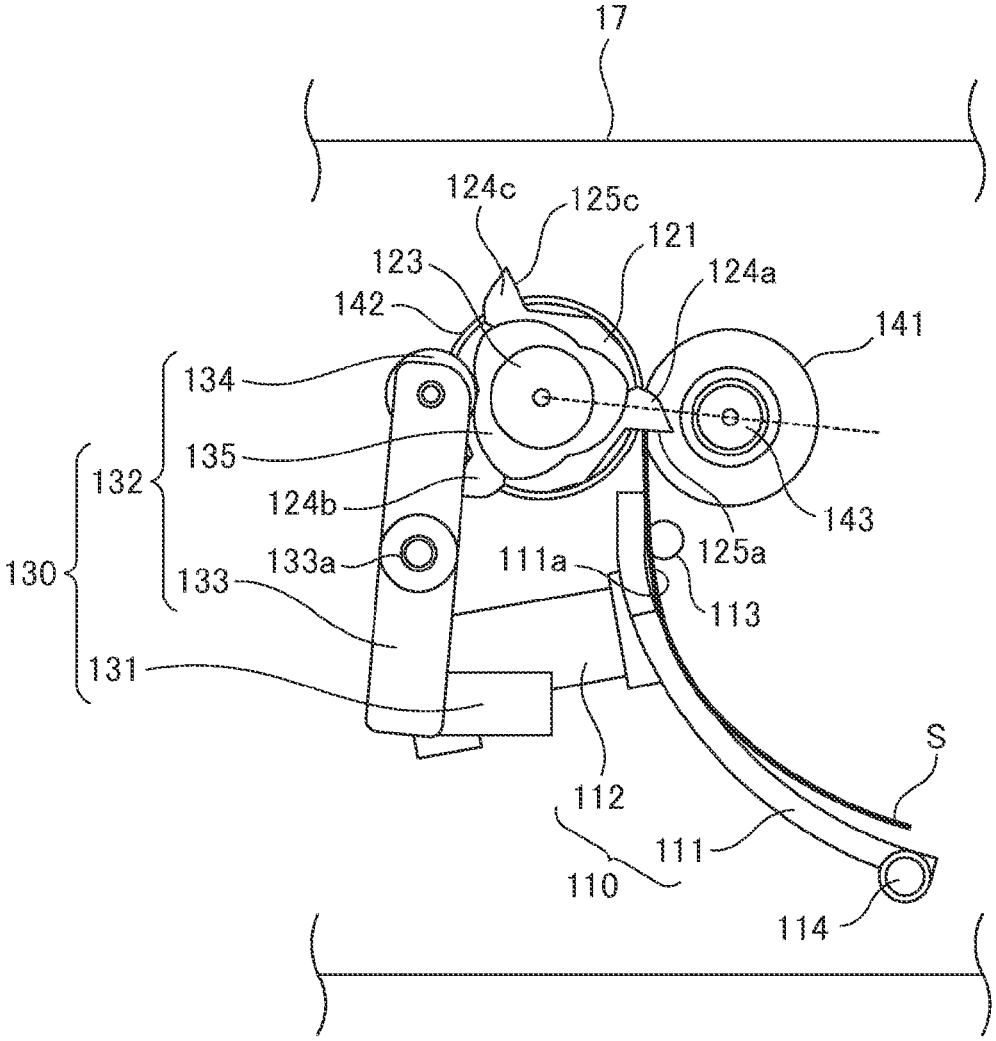
FIG. 3 is a side view of the skew correcting portion shown in FIG. 2.

As shown in FIGS. 2 and 3, the skew correcting portion 100 includes a conveyance guide portion (guide portion) 110 guiding the sheet S conveyed from the first conveying roller pair 30, and a rotary shutter portion 120 correcting a skew of the sheet S guided thereto. The skew correcting portion 100 also includes a bias portion 130 biasing the rotary shutter portion 120 and a second conveying roller pair (conveying roller pair) 140 conveying the sheet S whose skew has been corrected.

The conveyance guide portion 110 includes a guide body 111 turnable centering on a rotary shaft 114, a guiding bias spring 112 biasing the guide body 111, and a stopper 113 restricting the turn of the guide body 111. The guide body 111 includes the turning shaft 114 extending in a direction orthogonal to a conveying direction at upstream in the conveying direction. The turning shaft 114 is turnably supported by a frame 17 of the printer 10. The guiding bias spring 112 biases the guide body 111 from a side opposite a sheet guide surface 111*a* of the guide body 111. The stopper 113 is provided on the frame so as to face the sheet guide surface 111*a* and positions the guide body 111 at its initial position by restricting the turn of the guide body 111 biased by the guiding bias spring 112 by abutting against the sheet guide surface 111*a*.

The rotary shutter portion 120 turning in a predetermined direction includes a plurality of shutter members (four in the present embodiment) 121 and a shutter shaft 123 around which the plurality of shutter members 121 is fixed. The plurality of shutter members 121 is fixed to the shutter shaft 123 substantially at equal intervals, and is provided with three abutting members 124*a*, 124*b* and 124*c* in a circumferential direction thereof. The plurality of shutter members 121 is fixed to the shutter shaft 123 such that intervals (phases) among the abutting members 124*a* through 124*c* of the respective shutter members 121 are synchronized. That is, the abutting members 124*a* through 124*c* are provided such that they project in an outer radial direction from an outer circumferential surface of the shutter member 121 with predetermined intervals in the circumferential direction. The three abutting members 124*a* through 124*c* are provided with abutting surfaces 125*a*, 125*b* and 125*c*, respectively, against which the front end of the sheet S abuts. The abutting surfaces 125*a* through 125*c* are provided such that they are located at upstream in the sheet conveying direction of a nip of the second conveying roller pairs 140 when each of the abutting members 124*a* through 124*c* is located at a standby position described below. It is noted that while the present embodiment will be explained by exemplifying the shutter member 121 having the three abutting members 124*a* through 124*c*, a number of the abutting members is not limited to three. It is noted that abutting portions of the shutter member 121 against which the sheet abuts are formed by the plurality of abutting members 124*a* through 124*c* in the present embodiment. Still further, the shutter shaft 123, i.e., a rotary shaft, is rotatably supported by the frame 17 through an intermediary of shutter bearings 129.

That is, the standby position is an angular position of the shutter member 121/abutting members 124*a* through 124*c* where the abutting surface 125*a* is located upstream in the conveying direction of the nip of the second conveying roller pair 140 and where the front end of the sheet S guided along the conveyance guide portion 110 can abut against the abutting surface 125*a* as shown in FIG. 3 for example. A nip position is an angular position of the shutter member 121/abutting members 124*a* through 124*c* where the front end of the sheet S is nipped by the second conveying roller pair 140, and a recede position is an angular position of the shutter member 121/abutting members 124*a* through 124*c* where the abutting member recedes from the sheet conveying path such that the sheet S can pass through. The cam portions 136*b* and 136*c* are formed into the same shape with the cam portion 136*a*, so that their explanation will be omitted herein after.

The bias portion 130 includes the bias spring 131 and a conversion portion 132 converting a bias force of the bias spring 131 into a turning force. The conversion portion 132 includes a bias arm 133 oscillably supported by the frame 17, a cam follower 134 turnably supported at a front end of the bias arm 133, and a bias cam (cam) 135 in contact (frictional contact) with the cam follower 134. The bias arm 133 is supported by the frame 17 oscillably centering on a turning shaft 133*a* provided substantially at a center part in a longitudinal direction of the bias arm 133 and is configured such that the cam follower 134 provided at the front end of the bias arm 133 comes into contact with the bias cam 135 as a base end part of the bias arm 133 is biased by the bias spring 131. That is, the bias arm 133 and the bias spring 131 compose a bias mechanism biasing the cam follower 134, i.e., a cam contact member in contact with an outer circumferential surface of the cam, toward the outer circumferential surface of the bias cam 135.

Figure 4A:
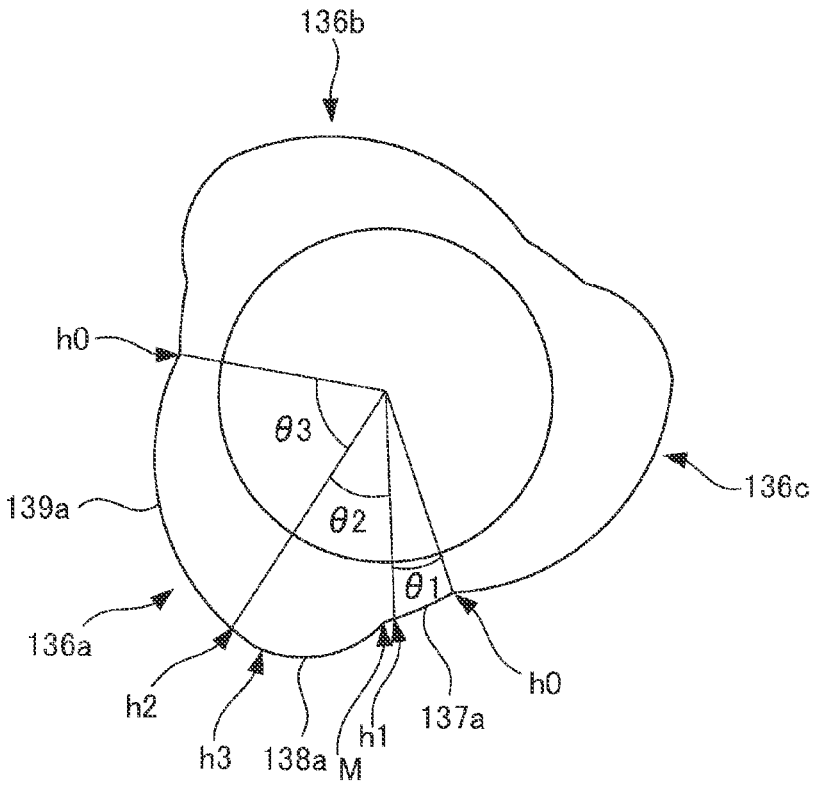
FIG. 4A illustrates a bias cam of a bias portion of the present embodiment.

The bias cam 135 is fixed to the shutter shaft 123 and turns together with the plurality of shutter members 121. That is, the bias cam 135 is coaxial with the plurality of shutter members 121 and turns together with the plurality of shutter members 121. As shown in FIG. 4A, the bias cam 135 includes a same number of cam portions 136*a*, 136*b* and 136*c* with the abutting members 124*a* through 124*c*. The cam portions 136*a* through 136*c* are formed in the circumferential direction such that their phase is equalized with that of the abutting members 124*a* through 124*c*. That is, the abutting members 124*a* through 124*c* are arranged such that they turn in linkage with shapes of the cam portions 136*a* through 136*c*. Specifically, the abutting member 124*a* turns in linkage with the cam portion 136*a*, the abutting member 124*b* turns in linkage with the cam portion 136*b*, and the abutting member 124*c* turns in linkage with the cam portion 136*c*.

The cam portion 136*a* includes a first cam surface 137*a*, a second cam surface 138*a*, and a third cam surface 139*a*, and changes the bias force of the bias spring 131 by changing heights of the respective surfaces of the cam. More specifically, a plurality of sets of the first and second cam surfaces 137*a* and 138*a* described above as resistance cam surface and the third cam surface 139*a* as a driving cam surface is provided around an outer circumferential surface of the bias can 135 as the cam portion 136*a* corresponding to the respective abutting members 124*a* through 124*c*.

That is, in the present embodiment, the first and second cam surfaces 137*a* and 138*a* form the resistance cam surface generating a force in a direction resistant to the turn of the shutter member 121 through the shutter shaft 123 when the sheet abuts against the abutting members 124*a* through 124*c*. The third cam surface 139*a* is formed continuously from the resistance cam surface and forms the driving cam surface generating a force of turning the shutter member 121 in the turning direction. In other words, The first and second cam surfaces 137*a* and 138*a* is the resistant cam surface converting a force of the biasing spring 131 into a force resistant to a turn of the shutter member 121 when the shutter member turns in a predetermined turning direction by being pushed by the conveyed sheet and the third cam surface 139*a* is the driving cam surface converting the force of the biasing spring 131 to a force of turning the shutter member 121 in the predetermined turning direction.

Here, the first cam surface 137*a* is a cam surface from a recess h0 to a change point M. The second cam surface 138*a* is a cam surface from the change point M to an apex portion (upper dead point) h3. A rate of increase of the bias force when the cam follower 134 is in contact with the first cam surface 137*a* is smaller than a rate of increase of the bias force when the cam follower 134 is in contact with the second cam surface 138*a*. That is, an inclination of the cam surface of the first cam surface 137*a* is smaller than an inclination of the second cam surface 138*a*. It is noted that the rate of increase of the bias force is a rate of increase of the force applied to the shutter member 121 by the bias spring 131 with respect to a turning amount (angle) of the cam portion 136*a*. The third cam surface 139*a* is a cam surface from the apex portion h3 to a next recess h0. That is, the first cam surface 137*a* which is in sliding contact with the cam follower 134 during when the shutter member 121 turns by a predetermined angle (angle θ1 described later in the present embodiment) is formed such that a pressure angle (maximum pressure angle) β (see FIG. 5A) of the first cam surface 137*a* with the cam follower 134 is smaller than that of the second cam surface 138*a* in sliding contact with the cam follower 134 when the shutter member 121 turns by more than the predetermined angle. It is noted here that the pressure angle β is an angle of a common normal line of the cam and the follower (cam follower) with respect to a moving direction of the follower (an angle formed between the moving direction of the follower and a direction in which the cam is propelled). That is, the first cam surfaces 137*a* is a cam surface in contact with the cam follower 134 when a sheet possibly askew before entering the nip portion of the second conveying roller pair 140 is corrected by abutting against the shutter member 121, and the second cam surface 138*a* is a cam surface coming in contact with the cam follower 134 when the shutter member 121 turns by being pushed by the sheet conveyed by the second conveying roller pair 140 after the correction. Then, the first cam surface 137*a* is formed such it requires smaller turning torque to turn the cam portion 136*a*/shutter member 121 than that required by the second cam surface 138*a*.

Figure 4B:
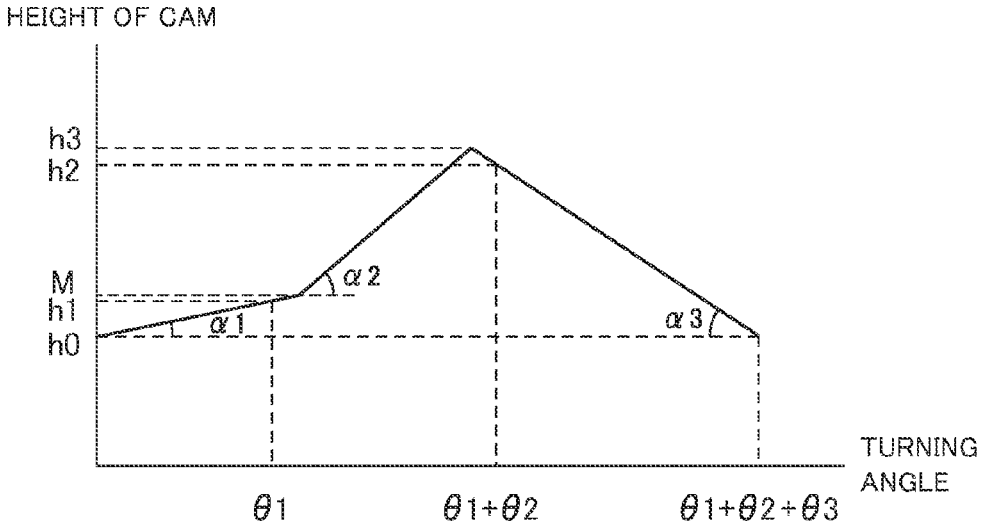
FIG. 4B is a graph illustrating a relationship between heights and turning angles of the cam.

More specifically, the cam follower 134 is in contact with the first cam surface 137*a* during the turning angle θ1 of the shutter member 121 until when the abutting member 124*a* turns from the standby position to a nip position. As shown in FIGS. 4A and 4B, because the first cam surface 137*a* is in contact with the cam follower 134 during when the shutter member 121 turns from the standby position (corresponding to the height of the cam at the recess h0) to the nip position (corresponding to the height of the cam at h1), the inclinational (see FIG. 4B) is small. That is, the rate of increase of the bias force applied from the bias portion 130 to the shutter member 121 is lowered when the shutter member 121 turns by being pushed by the sheet S conveyed by the first conveying roller pair 30 within the turning angle θ1 so that the bias force moderately increases. It is noted that if the cam follower 134 is located at the recess h0, the abutting member 124*a* is positioned at the standby position so that the bias cam 135 does not turn by the bias force of the bias spring 131.

The second cam surface 138*a* corresponds to a turning angle θ2 of the shutter member 121 during which the abutting member 124*a* turns from the nip position (corresponding to the height of the cam at hl) to a right-before position (corresponding to the height of the cam at h2) in which the rear end of the sheet S passes through. As shown in FIGS. 4A and 4B, an inclination α1 of the second cam surface 138*a* to the apex portion h3 is greater than the inclination during the turning angle θ1 (α2>α1) so that the apex portion h3 of the cam becomes high during when the abutting member 124*a* is pushed by the sheet S nipped by the second conveying roller pair 140. That is, the rate of increase of the bias force of the bias portion 130 applied to the shutter member 121 during the turning angle θ2 is increased more than that during the turning angle θ1 to position the next abutting member 124*b* reliably at the standby position when the rear end of the sheet S passes through.

It is noted that it is needless to say that the bias force (turning force) increases most at the apex portion h3 of the cam and the bias direction of the bias spring 131 changes from the apex portion h3. The bias portion 130 generates a reaction force against the sheet abutting the shutter member 121 when the cam follower 134 is located at the first cam surface 137*a* or the second cam surface 138*a*. When the cam follower 134 is in contact with the third cam surface 139*a*, the direction in which the bias force of the bias portion 130 acts on the shutter member 121 in terms of a turning direction of the shutter member 121 is reversed from the direction until then. That is, the shutter member 121 is turned in the direction in which the shutter member 121 has been turning by being pushed by the sheet.

The cam follower 134 comes in contact with the third cam surface 139*a* during when the turning angle of the shutter member 121 is θ3 from the right-before position in which the rear end of the sheet S passes through until when the next abutting member 124*b* is located at the standby position. As shown in FIGS. 4A and 4B, the cam height of the third cam surface 139*a* is returned from the right-before position (height of the cam at h2) to the standby position (height of the cam at a recess at h0) so that the next abutting member 124*b* is positioned at the standby position. That is, if an inclination of the third cam surface is assumed to −α3, a relationship of α2>α1>−α3 holds.

The second conveying roller pair 140 is provided downstream in the sheet conveying direction of the first conveying roller pair 30 and includes conveying rollers 141 divided into a plurality of rollers, and a plurality of conveying rolling members 142 divided into a same number of the conveying rollers 141 and is in pressure contact with the conveying rollers 141. The plurality of conveying rollers 141 is fixed to a rotary shaft 143 running in parallel with the shutter shaft 123. The rotary shaft 143 is turnably supported by the frame 17. The plurality of conveying rolling members 142 is turnably supported by the shutter shaft 123 and follows the rotation of the plurality of conveying rollers 141. It is noted that the plurality of shutter members 121 described above is disposed between the plurality of conveying rolling members 142.

Next, an operation of correcting a skew of the sheet S performed by the skew correcting portion 100 constructed as described above will be explained with reference to FIGS. 3 and 5.

When the sheet S is conveyed by the first conveying roller pair 30, the sheet S comes into contact with the sheet guide surface 111*a* of the guide body 111 and is guided toward the abutting member 124*a* of the shutter member 121 while sliding on the sheet guide surface 111*a*. At this time, a position of the guide body 111 is determined by a relationship between a contact force of the sheet S applied to the guide body 111 when the front end of the sheet S comes into contact with the sheet guide surface 111*a* and the bias force of the guiding bias spring 112. Thereby, an abutment position of the front end of the sheet S against the abutting surface 125*a* of the abutting member 124*a* is also determined. That is, the abutment position of the sheet S against the abutting surface 125*a* is determined corresponding to stiffness of the sheet S. It is noted that the abutment position of the sheet S corresponding to the stiffness of the sheet S will be described later in detail.

Next, when the front end of the sheet S abuts against the abutting surface 125*a* of the abutting member 124*a* located at the standby position, the sheet S forms a loop as shown in FIG. 3. The front end of the sheet S conforms to the abutting surface 125*a* by forming the loop and a skew of the sheet S is thus corrected. Then, when the pressure of the sheet S exceeds the bias force generated by the bias portion 130 in a direction of an arrow A shown in FIG. 5A, the shutter member 121 starts to turn in a direction of an arrow B shown in FIG. 5A.

At this time, the first cam surface 137*a* of the bias cam 135 is formed such that the rate of increase of the bias force caused by the bias portion 130 and applied to the shutter member 121 is lowered during the turning angle θ1. Therefore, the shutter member 121 becomes easy to turn in the direction of the arrow B while resisting against the bias force when the front end of the sheet S abuts against the abutting surface 125*a*, so that a shock to the front end of the sheet S is eased. This arrangement makes it possible to prevent the front end of the sheet S from being flawed by dents or the like. This arrangement makes it also possible to prevent the conveyance of the sheet S from being delayed or the sheet S from being stagnated by allowing the shutter member 121 to be readily turned to the nip position when the front end of the sheet S abuts against the abutting surface 125*a*.

When the shutter member 121 turns in the direction of the arrow B and the sheet S is nipped by the second conveying roller pair 140, the shutter member 121 is pressed by the sheet S nipped by the second conveying roller pair 140 and turns further in the direction of the arrow B while resisting against the bias force of the bias portion 130. The second cam surface 138*a* is formed such that the rate of increase of the bias force until when the cam follower 134 reaches the apex portion h3 by being pushed by the sheet S nipped by the second conveying roller pair 140 is greater than the rate of increase of the bias force until when the sheet S is nipped by the second conveying roller pair 140. The second cam surface 138*a* is also formed such that the rate of increase of the bias force caused by the bias portion 130 and applied to the shutter member 121 during the turning angle θ2 is greater than that during the turning angle θ1. Therefore, it is possible to increase the turning force (resistance force against the bias force) turning the shutter member 121 during when the shutter member 121 is pressed by the sheet S. This arrangement makes it possible to increase the turning force caused by the bias portion 130 for positioning the next abutting member 124*b* at the standby position after when the cam follower 134 crosses over the apex portion h3.

Figure 5A:
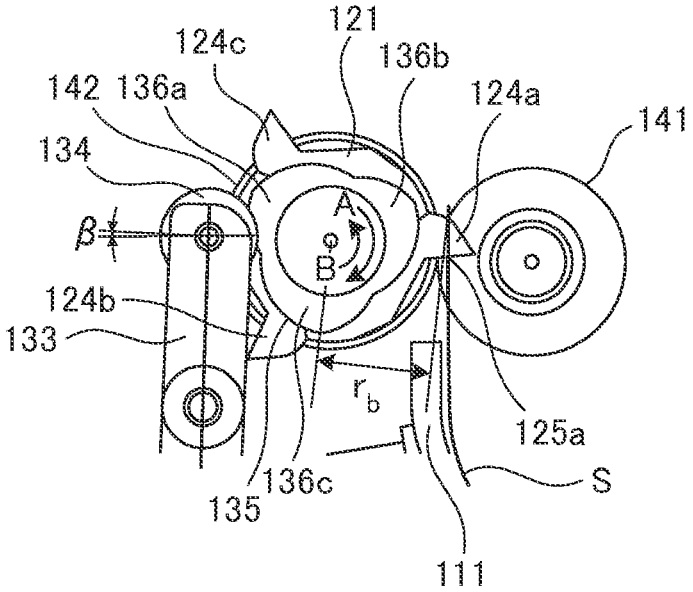
FIG. 5A illustrates a state in which a shutter member is turned by angle θ1 by a sheet abutting against an abutting member of the shutter member.
Figure 5B:
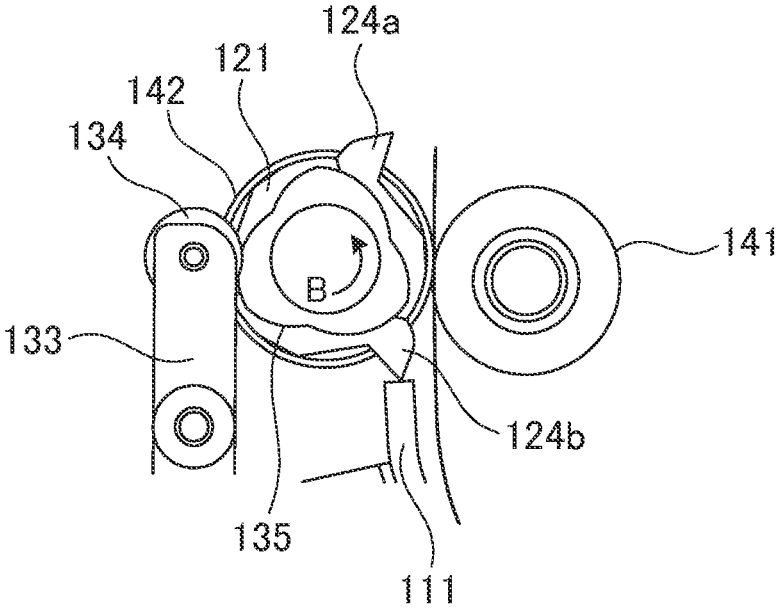
FIG. 5B illustrates a state in which the shutter member is turned by angle θ2.

When the shutter member 121 turns by being pushed by the sheet S nipped by the second conveying roller pair 140 and the cam follower 134 moving along the second cam surface 138*a* of the bias cam 135 moves over the apex portion h3, the direction in which the bias force of the bias spring 131 acts on the shutter member 121 in terms of the rotation direction of the shutter member 121 changes from the direction of the arrow A to the direction of the arrow B. When the direction in which the bias force acting on the shutter member 121 changes to the direction of the arrow B, the shutter member 121 which has been pushed and turned by the sheet S in the direction of the arrow B is turned in the direction of the arrow B by the bias force of the bias spring 131. At this time, because the second cam surface 138*a* is formed such that the rate of increase of the bias force increases during the turning angle θ2, the cam height at the apex portion h3 increases and the turning force increases as shown in FIG. 5B. Due to that, the shutter member 121 turns in the direction of the arrow B with a strong turning force by the bias force of the bias spring 131 after crossing over the apex portion h3.

When the shutter member 121 turns in the direction of the arrow B by the bias force of the bias spring 131, the abutting member 124*a* turns toward the recede position and the next abutting member 124*b* turns toward the standby position. Then, the next abutting member 124*b* stands by in a state in contact with the surface of the sheet S until when the sheet S passes through. It is noted that the state in which the next abutting member 124*b* stands by in contact with the surface of the sheet S corresponds to a state in which the abutting member 124*b* turns by the turning angles θ1+θ2 from the standby position and the cam follower 134 comes in contact with the position of the cam height h2 (see FIGS. 4A and 4B). After that, the shutter member 121 turns in the direction of the arrow B by the bias force of the bias spring 131 as the rear end of the sheet S passes through the next abutting member 124*b*. Then, as the cam follower 134 engages with the recess h0, the abutting member 124*b* is positioned at the standby position. The skew correcting portion 100 repeats this operation every time when a sheet S is conveyed thereto and conveys the sheet S while correcting the skew of the sheet S.

Next, a sheet abutment position corresponding to stiffness of the sheet S will be explained with reference to FIGS. 6A and 6B.

Figure 6A:
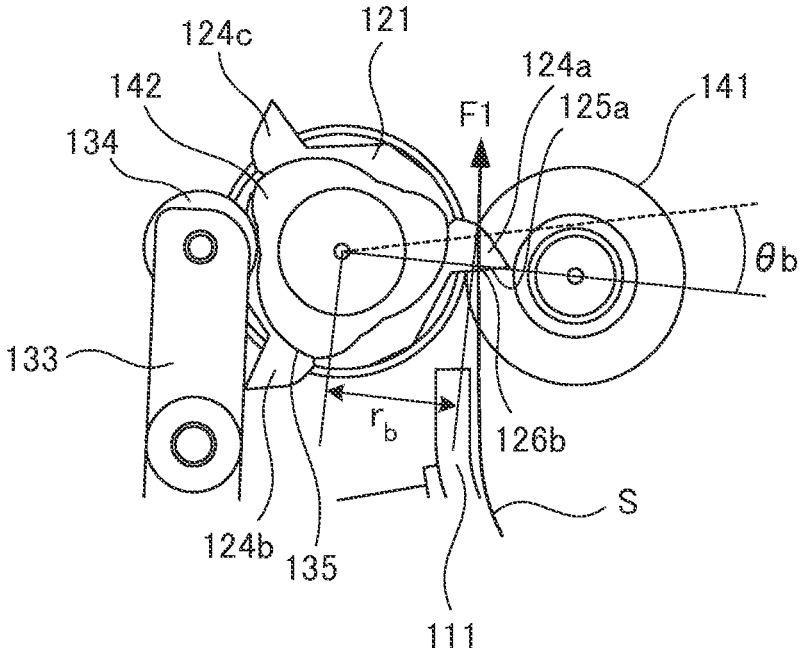
FIG. 6A illustrates a state in which a conveying guide of the present embodiment is turned by a sheet whose stiffness is low.
Figure 6B:
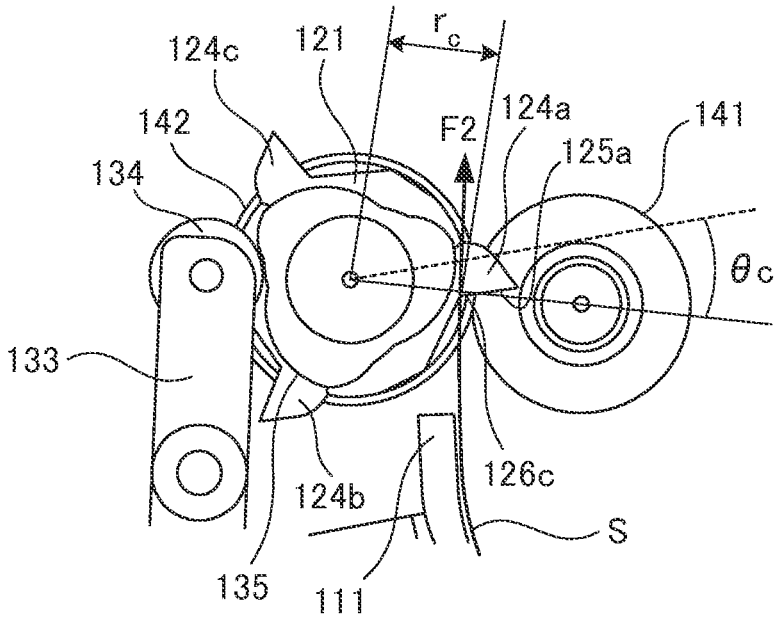
FIG. 6B illustrates a state in which the conveying guide is turned by a stiff sheet.

As shown in FIGS. 6A and 6B, a distance rb from a center of rotation of the shutter member 121 to the abutment position of the abutting surface 125*a* is longer than a distance rc from the center of rotation of the shutter member 121 to the abutment position of the abutting surface 125*a* (rb>rc). Still further, a turning angle θb when the abutting member 124*a* has turned from the standby position to the nip position as the sheet S abuts against the abutment position of the distance rb is smaller than a turning angle θc when the abutting member 124*a* has turned to the nip position as the sheet S abuts against the abutment position of the distance rc (θc >θb).

Here, the abutment position at the distance rb (front end side) will be referred to as a first abutment position 126*b*, and the abutment position at the distance rc (base end side) will be referred to as a second abutment position 126*c*. A cam height hb at a sheet feed position in the case where the sheet S abuts against the first abutment position 126*b* is lower than a cam height hc at the sheet feed position in the case where the sheet S abuts against the second abutment position 126*c* (hc>hb). Therefore, a fluctuation amount of the cam height with respect to the standby position (the cam height of the recess h0 is assumed to be h0) is large in the case where the sheet S abuts against the second abutment position 126*c* (hc−h0>hb−h0).

Pressure of the shutter member 121 is expressed by a product of the fluctuation amount of the cam height and a spring constant of the bias spring 131. Due to that, shutter pressure F1 at the nip position in the case where the sheet S abuts against the first abutment position 126*b* is smaller than shutter pressure F2 at the nip position in the case where the sheet S abuts against the second abutment position 126*c* (F2>F1).

This arrangement makes it possible to turn the shutter member 121 with a weak force in a case where the sheet S is less stiff (stiffness is low) as the sheet S abuts against a vicinity of the first abutment position 126*b* because a turning amount of the guide body 111 is small. As a result, it is possible to prevent the sheet S or the conveyance of the sheet S from being stagnated. Meanwhile, in a case where a sheet is stiff (stiffness is high), this arrangement makes it possible to turn the shutter member 121 with a strong force as the sheet S abuts against a vicinity of the second abutment position 126*c* because the turning amount of the guide body 111 is large. Thus, it is possible to correct a skew of the sheet S adequately without changing settings such as a sheet guide position (abutment position) per stiffness, e.g., basis weight, of the sheet S to be conveyed by providing the conveyance guide portion 110 constructed as described above.

As described above, the printer 10 of the present embodiment can prevent the front end of the sheet S from being flawed by dents or the like by moderately increasing the bias force from the standby position to the nip position during which the correction of skew is made. The printer 10 can also prevent the sheet S from not being conveyed to the nip position otherwise caused by a sudden increase of the bias force. Still further, it becomes possible to correct a skew right after the standby position because an initial bias force can be increased by moderating the bias force. It is also possible to assure the bias force necessary for reliably positioning the abutting member 124*a* of the shutter member 121 at the standby position by increasing the rate of increase of the bias force from the nip position to the right-before position where the sheet S passes through.

As described above, the printer 10 can correct the skew of the sheet S without flawing the front end of the sheet S by dents or the like and can position the next abutting member 124 reliably at the standby position by providing the shutter member 121 and by employing the bias cam 135 by which the rate of increase of the bias force is changed.

While the embodiment of the present invention has been described above, the present invention is not limited to the embodiment described above. The effects described in the embodiment of the present invention are merely what the most suitable effects brought about by the present invention are enumerated and the effects caused by the present invention are not limited to those described in the embodiment of the present invention.

For instance, although the present embodiment has been explained by exemplifying the bias spring 131 and the conversion portion 132 as the bias portion, the present invention is not limited to such configuration. The bias portion may be also configured such the rate of increase of the bias force applied to the shutter member is reduced by a plurality of bias springs by using the plurality of bias springs whose spring constants are different.

Still further, while the conversion portion has been explained by using the bias arm 133, the cam follower 134 and the bias cam 135 in the present embodiment, the present invention is not limited to such configuration. The conversion portion may be configured such that the bias force of the bias spring is converted into a turning force by using a link, a gear and others.

Still further, while the present embodiment has been explained by exemplifying the shutter member moving the abutting member to the standby position by turning in one direction, the present invention is not limited to such configuration. The shutter member may be also configured such that the abutting member that has moved from the standby position to the recede position is reciprocated to return to the standby position.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-160373, filed Aug. 1, 2013, which is hereby incorporated by reference herein in its entirety.

What is claimed is:

1. A sheet conveying unit comprising:

a conveying roller pair conveying a sheet;

a shutter portion including an abutting portion correcting a skew of a sheet by abutting against a front end of the sheet at a standby position upstream in a sheet conveying direction of a nip of the conveying roller pair, the abutting portion turning by being pushed by the sheet to a recede position where the sheet is permitted to pass through; and a bias portion biasing the shutter portion such that the abutting portion is positioned at the standby position, the bias portion configured such that a rate of increase of a bias force applied from the bias portion to the shutter portion during when the abutting portion is turned from the standby position to a nip position where the sheet is nipped by the conveying roller pair is smaller than a rate of increase of the bias force during when the abutting portion turns by being pushed by the sheet nipped by the conveying roller pair from the nip position.

2. The sheet conveying unit according to claim 1, wherein the bias portion generates a reaction force against the sheet that abuts against the abutting portion and turns the shutter portion, and applies a force of turning the shutter portion such that the abutting portion is positioned at the standby position as a rear end of the sheet passes through the shutter portion.

3. The sheet conveying unit according to claim 1, wherein the bias portion includes a bias spring and a conversion portion converting the bias force of the bias spring into a force of turning the shutter portion.

4. The sheet conveying unit according to claim 3, wherein conversion portion includes a cam turning with the shutter portion and a cam follower in contact with the cam while being biased by the bias spring.

5. The sheet conveying unit according to claim 4, wherein the cam includes a first cam surface corresponding to a turning angle of the shutter portion from the standby position to the nip position and a second cam surface corresponding to a turning angle of the shutter portion during when the abutting portion turns by being pushed by the sheet nipped by the conveying roller pair from the nip position; and an inclination of the first cam surface is reduced to be less than an inclination of the second cam surface.

6. The sheet conveying unit according to claim 5, wherein the cam includes a third cam surface with which the cam follower comes into contact after when the cam follower moves over an upper dead point as the shutter portion is pressed by the sheet nipped by the conveying roller pair, and wherein the cam converts the bias force of the bias spring such that a direction in which the bias force of the bias spring acts on the shutter portion in terms of a turning direction of the shutter portion in a state in which the cam follower comes in contact with the third cam surface is reversed from a direction in which the bias force of the bias spring acts on the shutter portion in terms of the turning direction of the shutter portion in a state in which the cam follower comes in contact with the first cam surface and the second cam surface.

7. The sheet conveying unit according to claim 1, wherein the abutting portion of the shutter portion includes a plurality of abutting members provided in a circumferential direction of the shutter portion and coming into contact with a sheet, and wherein the shutter portion turns until when a next abutting member is positioned at the standby position when one abutting member located at the standby position starts to turn by being pressed by a sheet.

8. The sheet conveying unit according to claim 7, wherein the shutter portion is put into a state in which the abutting member is in contact with a surface of the sheet after when the front end of the sheet abutted against the one abutting member and the abutting member has turned, and shutter portion turns until when a next abutting member is positioned at the standby position by the bias force of the bias portion as a rear end of the sheet passes through the shutter portion.

9. The sheet conveying unit according to claim 1, further comprising a guide portion guiding the front end of the sheet to the abutting portion located at the standby position, the guide portion guiding the sheet such that the lower the stiffness of the sheet, the closer to the front end of the abutting portion.

10. The sheet conveying unit according to claim 9, wherein the guide portion includes a guide body turnable centering on a rotary shaft orthogonal to a sheet conveying direction, a guiding bias spring biasing the guide body from a side opposite a sheet guide surface of the guide body guiding the sheet, and a stopper abutting against the sheet guide face and restricting the turn of the guide body biased by the bias spring, wherein a sheet guide position is determined by the guide body turning while resisting against the bias force of the guiding bias spring by its sheet guide surface being pressed by the sheet.

11. The sheet conveying unit according to claim 1, wherein bias portion includes a cam turning with the shutter portion, a biasing spring, and a cam follower in contact with the cam while being biased by the biasing spring, wherein the cam includes a resistant cam surface converting a force of the biasing spring into a force resistant to a turn of the shutter portion when the shutter portion turns in a predetermined turning direction by being pushed by the conveyed sheet, and a driving cam surface converting the force of the biasing spring to a force of turning the shutter portion in the predetermined turning direction.

12. An image forming apparatus comprising:

a sheet conveying unit described in claim 1; and an image forming portion configured to form an image on a sheet fed from the sheet conveying unit.

13. A sheet conveying unit comprising:

a turning shaft;

a shutter member attached to the turning shaft and including a plurality of abutting members projecting in an outer radial direction from an outer circumferential surface thereof and provided at predetermined intervals in a circumferential direction;

a cam attached to the turning shaft, the cam including, on its outer circumferential surface corresponding to each abutting member, a plurality of sets of a resistance cam surface generating a force resistant to a turn of the shutter member through the intermediary of the turning shaft when the shutter member turns in a turning direction by being pushed by the sheet abutting against the abutting member, and a driving cam surface formed continuously to the resistance cam surface and generating a force of turning the shutter member in the turning direction; and a bias mechanism including a cam contact member being in contact with the outer circumferential surface of the cam and a bias member biasing the cam contact member to the cam, wherein the resistance cam surface includes a first cam surface having a first radius of curvature and with which the cam contact member is in sliding contact until the shutter member turns by a predetermined angle, and a second cam surface having a second radius of curvature and with which the cam contact member is in sliding contact until the shutter member turns more than the predetermined angle, and wherein the first cam surface is formed such that the first radius of curvature is larger than the second radius of curvature and a pressure angle of the first cam surface with the cam contact member is smaller than a contact angle of the second cam surface with the cam contact member.

* * * * *